US005589839A

United States Patent [19]

Lindenmeier et al.

[11] Patent Number: 5,589,839

[45] Date of Patent: Dec. 31, 1996

[54] RADIO ANTENNA ARRANGEMENT LOCATED NEXT TO VEHICLE WINDOW PANELS

[76] Inventors: Heinz Lindenmeier, Fürstenrieder Strasse 7 b, D-8033 Planegg; Jochen Hopf, Salmdorfer Strasse 3 a, D-8013 Haar; Leopold Ritter, Ludwig-Thoma-Strasse 9, D-8031 Gilching, all of Germany

[21] Appl. No.: 613,021

[22] Filed: Mar. 11, 1996

Related U.S. Application Data

[63] Continuation of Ser. No. 185,955, filed as PCT/DE93/00369, Apr. 27, 1993 published as WO93/23890, Nov. 25, 1993, abandoned.

[30] Foreign Application Priority Data

May 18, 1992 [DE] Germany ..... 42 16 377.3

[51] Int. Cl.$^6$ ..... H01Q 1/32

[52] U.S. Cl. ..... 343/713; 343/715; 343/841

[58] Field of Search ..... 343/704, 713, 343/715, 841; H01Q 1/32

[56] References Cited

U.S. PATENT DOCUMENTS

| | | | |
|---|---|---|---|
| Re. 33,743 | 12/1991 | Blaese | 343/715 |
| 3,766,563 | 10/1973 | Sauer et al. | 343/713 |
| 4,779,098 | 10/1988 | Blaese | 343/713 |
| 5,005,020 | 4/1991 | Ogawa et al. | 343/713 |
| 5,124,714 | 6/1992 | Harada | 343/713 |
| 5,132,161 | 7/1992 | Shibata et al. | 343/711 |
| 5,285,048 | 2/1994 | Nakase | 343/704 |

FOREIGN PATENT DOCUMENTS

| | | | |
|---|---|---|---|
| 0279117 | 8/1988 | European Pat. Off. . | |
| 0358090 | 3/1990 | European Pat. Off. . | |
| 177601 | 7/1990 | Japan | H01Q 1/32 |

*Primary Examiner*—Michael C. Wimer

[57] ABSTRACT

The antenna arrangement for a motor vehicle includes an exterior radio antenna (1) for radiating electromagnetic waves in a radio frequency broadcast range; a vehicle window pane (2) closing an opening provided in a metallic vehicle body (3) and a device for shielding the interior from the electromagnetic waves radiated by the exterior radio antenna (1). The device for shielding is a two-dimensional component (4) arranged on the window pane (2) and made of a conductive material substantially optically transparent but substantially opaque to the electromagnetic waves radiated by the exterior radio antenna (1) and a capacitive connection (11,12,13) for the electromagnetic waves in the radio broadcast frequency range between the two-dimensional component (4) and the metallic body (3). The two-dimensional component (4) has a sufficiently low surface resistance in the radio broadcast frequency range and the capacitive connection (11,12,13) has a sufficiently low impedance so that electric and magnetic fields radiated by the exterior radio antenna (1) are effectively prevented from penetrating into the interior of the motor vehicle.

26 Claims, 7 Drawing Sheets

RADIO ANTENNA ARRANGEMENT LOCATED NEXT TO VEHICLE WINDOW PANELS

This application is a continuation of application Ser. No. 08/185,955, filed as PCT/DE93/00369, Apr. 27, 1993 published as WO93/23890, Nov. 25, 1993, now abandoned.

BACKGROUND OF THE INVENTION

Radio antennas, e.g. for C-network or D-network mobile telephones, are frequently mounted rear of the rear edge of the roof in the shape of rods or in some other shape or are glued to the rear windshield for because of the good antenna function. In either case, the antennas face away from the outer shell of the vehicle and are therefore known as outer antennas in contrast, for example, to windshield antennas.

The antennas are typically driven or energized by up to 25 W for transmission. Because of their simple attachment, antennas glued to the rear windshield which couple in the antenna signals through the window pane are particularly advantageous. Such an antenna arrangement which is glued on the rear window of a vehicle is known, for example, from P 39 31 807 A1.

The electromagnetic radiation, i.e. the electric and magnetic fields, penetrates into the interior of the vehicle through openings in the window pane adjacent to the antenna. In the conventional points of attachment on the rear edge of the roof or, in the case of glued antennas, on the rear window, this is chiefly the rear windshield. But to a lesser extent other adjacent window pane openings, e.g. those of the rear side windows, can also participate in coupling fields into the interior of the vehicle.

Modern rear windshields, as a rule, have window pane heating devices formed either by printed, usually horizontally arranged conductors or by a plurality of horizontal individual wires which are imbedded between the two panes of a composite or laminated glass. Such conductor structures exhibit a certain shielding action with respect to the coupling of electromagnetic fields into the interior and reduce the field strengths in comparison to rear windshields without a heating field. However, this action is slight when no special measures are taken with respect to the design of the heating arrangement. This is also a result of the fact that vertical polarization is used in radio systems and radio antennas are usually arranged centrally in relation to the longitudinal axis of the vehicle. The resulting field configuration is one in which horizontally arranged heating conductors are not suitable for guiding the currents back to the base of the antenna. The shielding effect of normal heating fields is accordingly low.

In special cases, heating conductors which are arranged orthogonally to the maximum window pane dimension and have bus bars at the upper and lower edges of the window pane are also used. Window panes with metallic coatings which are deposited by evaporation are likewise technically feasible at present. Window panes heated in this way provide more favorable preconditions for a shielding action with respect to the field configuration. Nevertheless, the shielding effect is still inadequate, since the grounding ratios of the window pane heaters constructed according to the prior art are undefined for the frequencies of radio systems.

As shown by measurements, the field strengths occurring in the vehicle interior are generally considerable. At transmission outputs of up to 25 W typically used in mobile radio, antennas which are mounted on the outer shell in the vicinity of the rear edge of the roof already produce electric and magnetic field strengths rear heads of the rear passengers attaining or even exceeding the limits outlined in DIN Draft 0848.

The situation is even more problematic in the case of antennas glued to the glass. Since very high field strengths occur chiefly in the vicinity of the antenna base, the limits outlined in DIN Draft 0848 are exceeded in extensive areas of the passenger compartment. The special constructional form of the antennas has a considerable influence on the field distribution in this case.

In none of these cases can a risk to passengers be safely excluded.

The object of the invention is therefore to provide an antenna arrangement by which the fields in the passenger compartment are significantly reduced while fully retaining the output of the outer antenna with respect to radio operation.

According to the invention, the antenna arrangement for a motor vehicle having a metallic body and an interior includes an exterior radio antenna for radiating electromagnetic waves in a radio frequency broadcast range; a vehicle window pane closing an opening provided in the metallic body of the motor vehicle, the exterior radio antenna being arranged on either the metallic body or the window pane outside of the interior, and a device for shielding the interior from the electromagnetic waves radiated by the exterior radio antenna. The device for shielding the interior from the radiated electromagnetic waves includes a two-dimensional component arranged on the window pane and made of a conductive material substantially optically transparent but substantially opaque to the electromagnetic waves radiated by the exterior radio antenna and a capacitive connection between the two-dimensional component and the metallic body for the electromagnetic waves in the radio broadcast frequency range. The two-dimensional component according to the invention must have a sufficiently low surface resistance in the radio broadcast frequency range and the capacitive connection is of sufficiently low impedance in the radio broadcast frequency range so that electric and magnetic fields radiated by the exterior radio antenna in the radio broadcast frequency range are effectively prevented from penetrating into the interior of the motor vehicle.

In particular, both roof antennas and glued antennas can be used without difficulty with the antenna arrangements according to the invention, since the field strengths occurring in the passenger compartment can be kept safely below the limits specified in DIN Draft 0848 at present conventional maximum transmission outputs. Accordingly, the antennas according to the invention avoid the disadvantages of the prior art which pose a threat to passengers.

A particularly great advantage consists in that the extent of the reduction can be adapted to the requirements in question, such as maximum transmission output or type of antenna, by suitable selection of the magnitude, arrangement, and design of the two dimensional component so as to avoid unnecessary technical expenditure.

In vehicles outfitted with the antenna arrangements according to the invention, a further essential advantage consists in that the vehicle window pane having the two-dimensional component can be heated and also have structures which are suitable as antenna structures for radio reception without restricting the former function of vehicle window panes.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENT

Figure 1A:
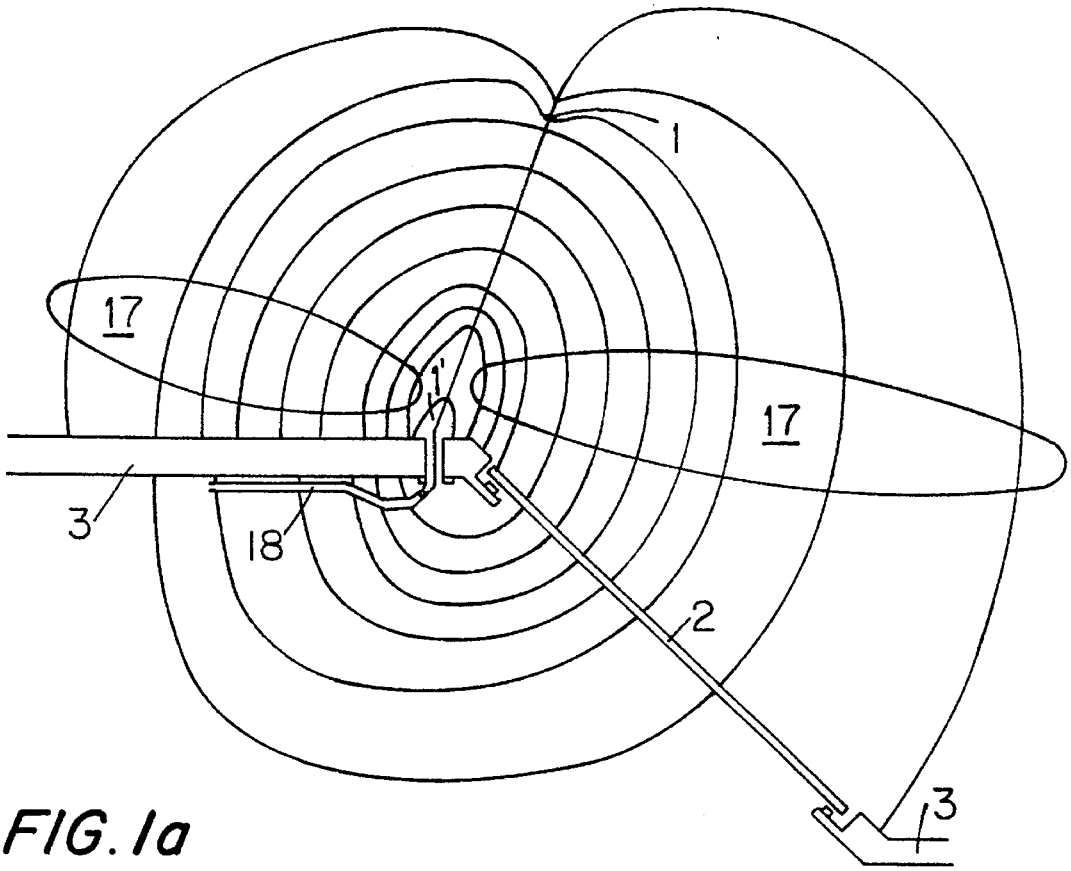
FIG. 1a PRIOR ART
FIG. 1*a* is a schematic side cross-sectional view of an antenna arrangement according to the prior exterior radio art with an outer antenna 1 which is mounted on the roof in the vicinity of the rear edge of the window pane and whose fields extend into the passenger compartment (section)
Figure 1B:
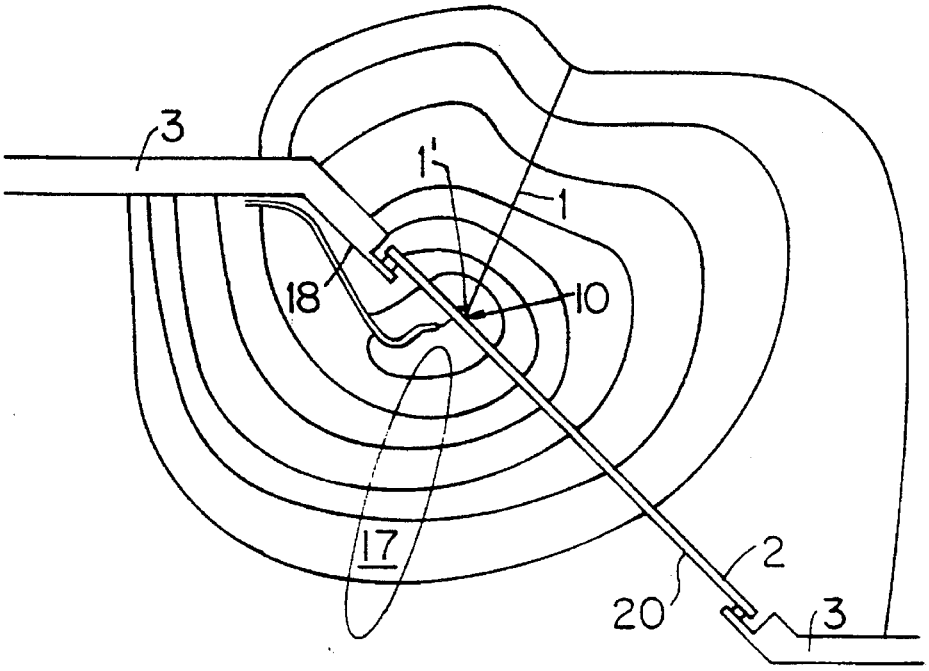
FIG. 1b PRIOR ART
FIG. 1*b* is a schematic side cross-sectional view of a glued antenna arranged according to the prior art.

FIGS. 1*a* and 1*b* show antenna arrangements according to the prior art. In the example shown in Fig. 1*a*, the exterior radio antenna 1 is an antenna which is mounted at the rear edge of the roof of the vehicle and arranged in the vicinity of the window pane opening closed by the window pane 2. In the example shown in FIG. 1*b*, the exterior radio antenna 1 is an antenna whose base 1' is fastened outside the vehicle to the vehicle window pane 2 at attachment point 10. In general, this is accomplished by gluing and such antennas are therefore known as glued antennas.

The signal connection between the antenna 1 and radio equipment is effected in a conventional manner via a coaxial line 18. In the example shown in FIG. 1*a*, the outer conductor of the coaxial line 18 has an electrically conductive connection with the body 3 in the vicinity of the antenna base in a conventional manner. In the example shown in FIG. 1*b*, the outer conductor of the coaxial line 15 is connected with the body in the vicinity of the antenna base 1' so as to be electrically conductive.

During transmission, lines of electric flux 17 radiate from the exterior antenna 1 and contact the metallic body (Figs. 1*a* and 1*b*). Dielectric displacement currents are linked with the lines of electric flux. These currents flow on the metallic body 3 at the antenna base as surface currents. There are also lines of magnetic flux which are not shown in FIGS. 1*a* and 1*b* and which extend at right angles to the lines of electric flux 17, i.e. pass out of the drawing plane.

In antenna arrangements according to the prior art, as shown in FIGS., 1*a* and 1*b*, some of the lines of electric flux 17 and accordingly also some of the lines of magnetic flux enter through openings in the body, e.g. through the window openings, into the passenger compartment and reside in the interior rear the metallic body 3. Persons in the region of the fields are accordingly exposed to electromagnetic energy.

Particularly high field strengths naturally occur in the immediate vicinity of the exterior radio antenna 1. Therefore, in the example shown in FIG. 1*a*, particularly high field concentrations also occur in the portion of the window pane opening which is adjacent to the antenna and identical with the window pane 2, i.e. in the upper region of the window pane. Accordingly, in the case of a rear window pane and an exterior radio antenna mounted at the rear edge of the roof, the passengers in the back are endangered especially in the head area. Naturally, the risk increases as the level of transmission output increases.

In the case of a glued antenna, as shown in FIG. 1*b*, even more lines of flux reach the interior, since there are no adequately large metallic opposite surfaces at the potential of the 3 in the immediate vicinity of the antenna base 1' in antenna arrangements of the prior art. For this reason, substantially higher field strengths are also noted in the vehicle interior. In the case of glued antennas, the electric connection of the outer conductor of the coaxial cable 18 with the metallic body 3 in the vicinity of the antenna base 10 may even be dispensed with occasionally because of the simple attachment. Accordingly, sheathing waves can propagate on the coxial cable 18 and cause high field concentrations in the interior even-at a great distance from the antenna base. Antennas with extra conductors arranged on the window pane as "radials" do not provide any improvement with respect to the unwanted field strengths in the interior of the vehicle.

In FIG. 1*b*, a portion of the rear window pane is covered by a heating field 20 as is common practice today. The heated area is arranged in the lower region of the window pane 2 and is smaller than the total window opening so that the glued antenna 1 can be mounted above the heating field in the unoccupied space. The heat conductors of the heating field do not have low-impedance electric connections with the body 3 for radio broadcast frequencies, since the wires 24 supplying the direct current are connected with the body ground or with the positive terminal of the battery only at a considerable distance. The placement and length of the wires 24 supplying the direct current (see FIG. 7 for the case of an antenna arrangement according to the invention) are designed according to the prior art to take into account aspects relating to the specific vehicle and are not geared toward the electrical effect for radio broadcast frequencies.

Therefore, in practice a normal heating field has only a slight shielding effect on the coupling of electromagnetic waves radiated by the outer antenna 1 into the interior. The fields penetrate into the interior through the heating field 20 without substantial weakening as shown in FIG. 1*b*.

Antenna arrangements, according to the invention, which bring about a significant reduction in the penetration of electromagnetic waves into the interior are described in the following. Such an antenna arrangement is shown in section in FIG. 2 and in a top view in FIG. 3 for a first embodiment exterior of an antenna 1 mounted at the rear edge of the roof.

Figure 2:
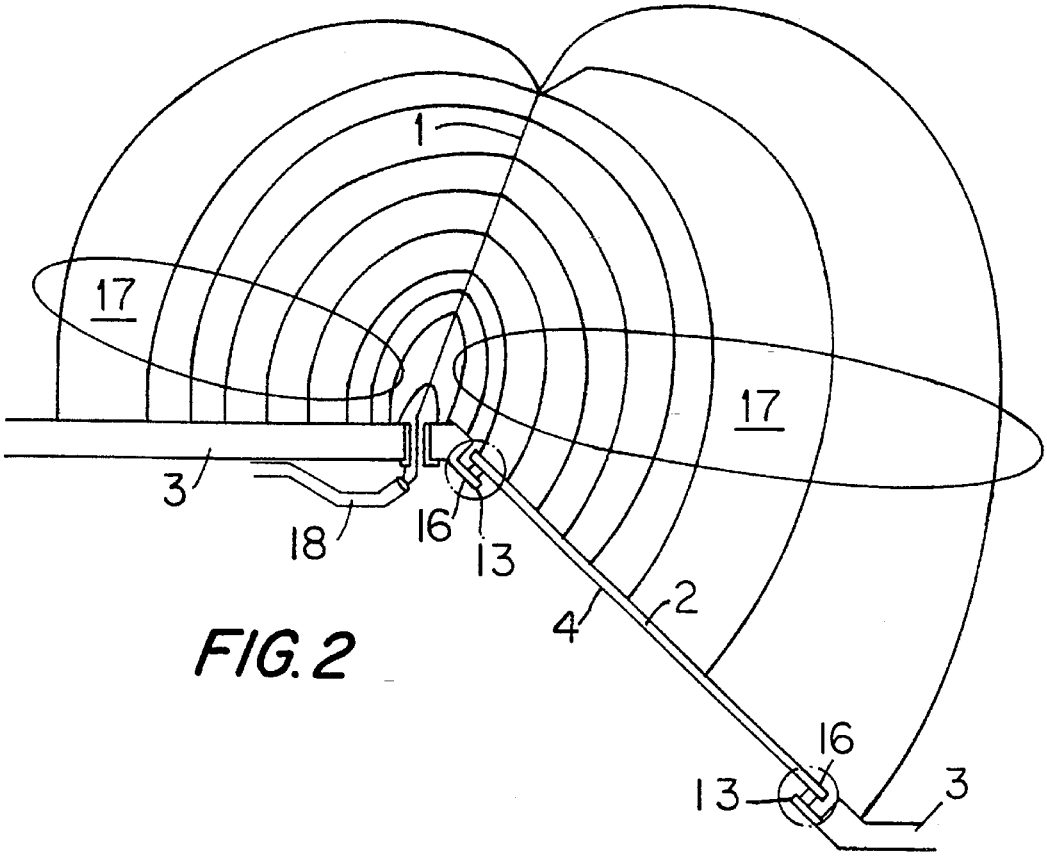
FIG. 2 is a schematic side cross-sectional view of another embodiment of an antenna arrangement according to the invention with an exterior radio antenna 1 which is mounted on the roof in the vicinity of the edge of the rear window and whose fields do not extend into the passenger compartment.
Figure 3:
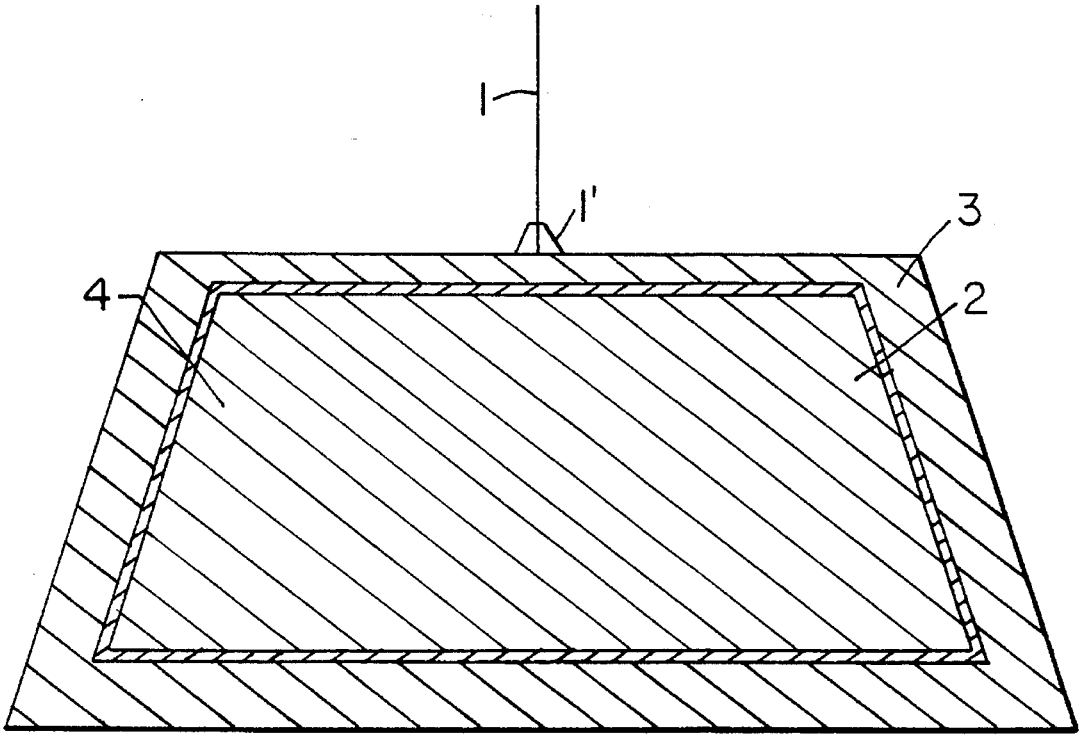
FIG. 3 is a plan view of the antenna arrangement according to the invention according to FIG. 2.

In contrast to FIG. 1*a*, the window pane 2 in the example shown in FIG. 2 or FIG. 3 is now provided with a two-dimensional, i.e. flat, component 4 of conductive material with low surface resistance in the radio broadcast frequency range. To achieve the advantages of the invention, a surface resistance of significantly lower impedance than the characteristic field wave impedance as a whole must be effective for the radio broadcast frequency range because of the two-dimensional component 4. The two-dimensional component 4 is then suitable for a shielding effect and can effectively prevent electric and magnetic fields generated by the exterior antenna 1 from penetrating into the interior of the vehicle.

With current technical capabilities, the two-dimensional component 4 can be evaporated on a surface area, e.g. in the form of a coating. These metallic coatings are evaporated on very thinly so as to remain transparent to light and achieve the required low impedance for radio frequencies.

However, components of individual conductors such as are known from printed heating fields which are applied by silk screen printing are equally suited for the antenna arrangements according to the invention. To achieve the desired effect with respect to reducing the coupling of electromagnetic fields into the interior, the teaching of the invention outlined below regarding the geometrical forms of the components are to be followed. It can also be advantageous to combine an evaporated coating with a printed conductor structure.

As a result of the small penetration depth of high-frequency radio waves due to the skin effect in metallic conductors, a very thin coating whose impedance would be too high for direct currents, e.g. for purposes of window pane heating, is sufficient. The necessary low impedance for direct current can be provided by printed conductors.

To achieve the advantages of the invention, at least one edge or border of the two-dimensional component 4 must have a low-impedance connection with the metallic body 3. In the case of FIG. 2 or FIG. 3, this is effected at all four edges of the two-dimensional component 4, resulting in the advantage of a particularly high efficiency within the meaning of the invention. In the example shown in FIGS. 2 and 3, the window pane 2 is inserted into the body 3 in the currently conventional manner and mechanically connected with the body by the window pane glue 13 which is applied as a bead of glue parallel to the outer edge of the window pane.

The electric low-impedance connection for radio broadcast frequencies can then be effected in many cases in a particularly simple and therefore advantageous manner, as indicated in the examples shown in FIGS. 2 and 3, by connecting of the edges of the body which are located opposite one another in a plane and by means of the edges of the structure by the bead of glue.

Ideally, the required low impedance of the connection can be achieved, for example, with a glue 13 which contains silver and which therefore has good conductive properties. In this way, the two-dimensional component 4 is at the potential of the body. The low-impedance connection to the body 3 can be effected in antennas according to the invention in a fundamentally different way. The use of a conductive glue mentioned above is ideal in electrical respects, but the high cost of such a glue is disadvantageous.

For reasons relating to construction, there is always an overlapping zone between the vehicle window pane 2 and the body 3 with a typical width of 1 to 2 cm along the edge of the window pane in modern vehicles in which the panes of glass are glued in. The comparatively small distance, typically 3 to 4 mm, between the two-dimensional component 4 and the opposite surface of the body 3 due to the bead of glue results in a considerable capacitive coupling which, because of the large surface area arrangement, represents a sufficiently low-impedance capacitive connection when the window pane glue arranged in this region has a dielectric constant substantially greater than 1. This is the case with the currently used window pane glues having typical $\epsilon_r$ values greater than 5.

Since the radio services for which the antenna arrangements according to the invention are preferably used generally have frequencies in the UHF range or higher, the capacitance which is formed in this way is sufficient for effecting a connection of sufficiently low impedance between the two-dimensional component 4 and body 3.

Some currently used window pane glues have low losses at high frequencies, while others have high losses due to a high soot component so that a high-impedance conductivity results in addition to the capacitive connection. For this reason, the use of such window pane glue also provides a reliable low-impedance connection between the body and the two-dimensional component 4 for the radio broadcast frequencies.

Figure 6:
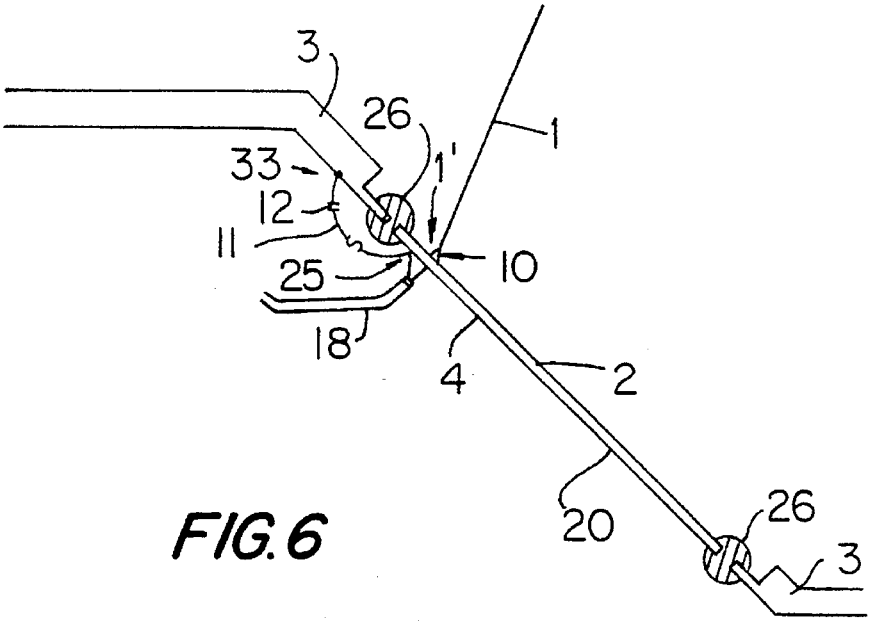
FIG. 6 is a schematic side cross-sectional view of a further embodiment of an antenna arrangement according to the invention, with a glued antenna and with a two-dimensional component covering only a part of the window pane opening and with a heating field occupying most of the remaining area.

However, the low-impedance connection between the two-dimensional component 4 and the body 3 required for antenna arrangements according to the invention can also be effected in a punctiform manner. This possibility is shown in section in FIG. 6 and in a top view in FIG. 7. It is assumed in this example that the window pane is inserted into the body with a rubber seal 26 as mentioned above. Consequently, a sufficiently low-impedance connection to the body 3 is not always provided since the edges of the two-dimensional component 4 and body 3 are only located opposite one another at their end sides. If the low impedance of the connection is not sufficient, which can be determined by measuring the impedance between the structure 4 and body 3, the low-impedance connection can be ensured exclusively or in a supplementary manner by one or more wire bridges from the two-dimensional component 4 of the body 3.

But even with a short wire bridge, the low impedance of a wire bridge is still not sufficient for the frequency ranges at which the radio systems in question are operated, i.e. substantially above approximately 400 MHz, due to the self-inductance of approximately 10 nH/cm. This is because a wire bridge with a length of roughly 10 cm, which it would be difficult to reduce, already results in an inductive impedance of approximately 280 ohms in the C-network frequency range. The low impedance for radio broadcast frequencies can be produced again by compensating for the self-inductance of the wire 11 with a series-connected capacitor 12. In the example, a capacitance of roughly 1.2 pF is required. An effective low-impedance connection is produced in this way between the connection points 25 on the two-dimensional component 4 and 3 of the body.

The selected location of the connection point 25 on the structure is preferably that at which the greatest reverse currents flow to the antenna base 1' because, electrically, this provides the most advantageous effect. In the example shown in FIG. 6, this location is the axis of symmetry of the window pane at the upper edge, i.e. in the immediate vicinity of the antenna base 10. The connection point 33 is preferably selected at the least possible distance from the connection point 25 on the body. Electrically, this connection has a series-resonant character.

A disadvantage of the low-impedance connection by wire bridges is the cost for mounting and contacting. The effective lowimpedance connection between the body 3 and the two-dimensional component 4 with respect to the connection point 25 can also be achieved in an electrically equivalent manner, and therefore in such a way that it carries out the same function, via a line transformation. This advantageously dispenses with the cost of arranging the wire bridges.

Figure 8:
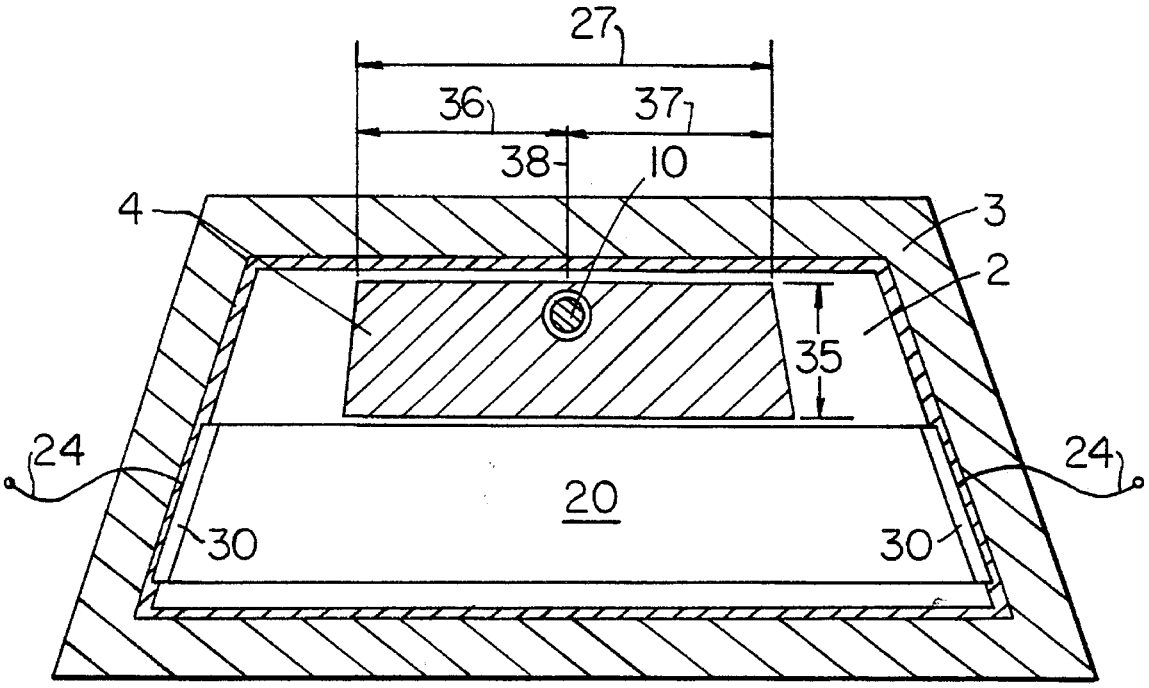
FIG. 8 is a schematic plan view of the antenna arrangement according to the invention with a low-impedance connection between the flat component and metallic body formed by a line transformation.

Such an embodiment form according to the invention is shown in FIG. 8. In this example, the line character is provided between the upper border or edge of the two-dimensional component 4 and the metallic body 3 located opposite the latter. The two-dimensional component 4 forms an open circuit on the left and right sides. The respective open circuit is transformed, depending on the length 36 or 37, into an impedance which acts between the two-dimensional component 4 and the body 3 in the vertical line of symmetry 38 and results in an AC short circuit with a series resonance character with suitably selected dimension 36, respectively, 37. The two-dimensional component 4 and accordingly also the dimensions 36 and 37 for the region of the two-dimensional component 4 lying to the left and right of the axis of symmetry 38 are constructed identically in a mirror-inverted manner. Accordingly, the overall horizontal dimensioning of the two-dimensional component 4 is given at 27 as the sum of the dimensions 36 and 37. The dimensions 36 and 37 for carrying out this objective typically result in a quarter-wave transformation or a transformation with similar characteristics (by an odd whole-number multiple of the quarter wave). The exact required dimensions 36 and 37 are preferably determined by measuring the impedance between the two-dimensional component 4 and the body on the axis 38 of symmetry, since the fields of the line along which the line transformation is effected are sometimes also present in the window pane 2 resulting in a somewhat shorter effective wavelength which diverges from the free-space wavelength.

Thus, as a result of the antenna arrangement according to the invention, the lines of electric flux radiating from the exterior radio antenna 1 end on the two-dimensional component 4 and only penetrate into the interior very weakly if at all. This is also true of the lines of magnetic flux. The fields of the radio antenna are accordingly prevented to a great extent from entering the interior of the vehicle.

In an antenna arrangement according to the invention, the greatest efficiency along with the advantage of a particularly large reduction in the fields in the interior of the vehicle is naturally provided when the two-dimensional component 4 extends over the entire surface of the window pane opening. In practice, however, an adequate, i.e. only slightly reduced, efficiency can be achieved by providing the two-dimensional component 4 on particularly important areas of the window pane.

These particularly important areas for achieving the advantages according to the invention are, in part, in the vicinity of the base of the exterior radio antenna 1, that is, in the upper middle region of the vehicle window pane 2 in the example shown in FIG. 2. As is well known, the highest field concentrations occur in this location. Similarly, in the case of an exterior radio antenna 1 constructed as a glued antenna (FIGS. 4 and 5), the region around the base 10 of the antenna is particularly important.

On the other hand, the closeness of parts of the passengers' bodies to the respective areas of the window pane 2 must also be taken into account. For this reason, the upper region of the window panes 2 is very important in every case, since the heads of the passengers in the rear can come very close to the window pane 2. In contrast, the lower region of the window pane 2 is substantially farther from the bodies of the passengers in the rear. This is particularly true if the window pane 2 is relatively flat.

Therefore, the efficiency of the two-dimensional component 4 in the upper region of the window pane and in the middle of this upper region is particularly great even though the outer antenna 1 is arranged there on the middle of the window pane 2 or in the vicinity of the body 3. For the same reasons, the two-dimensional component 4 need not be extended as far as the lower region of the window pane 2 or can be constructed at least at a lower technical cost in these areas without practical disadvantages.

Figure 4:
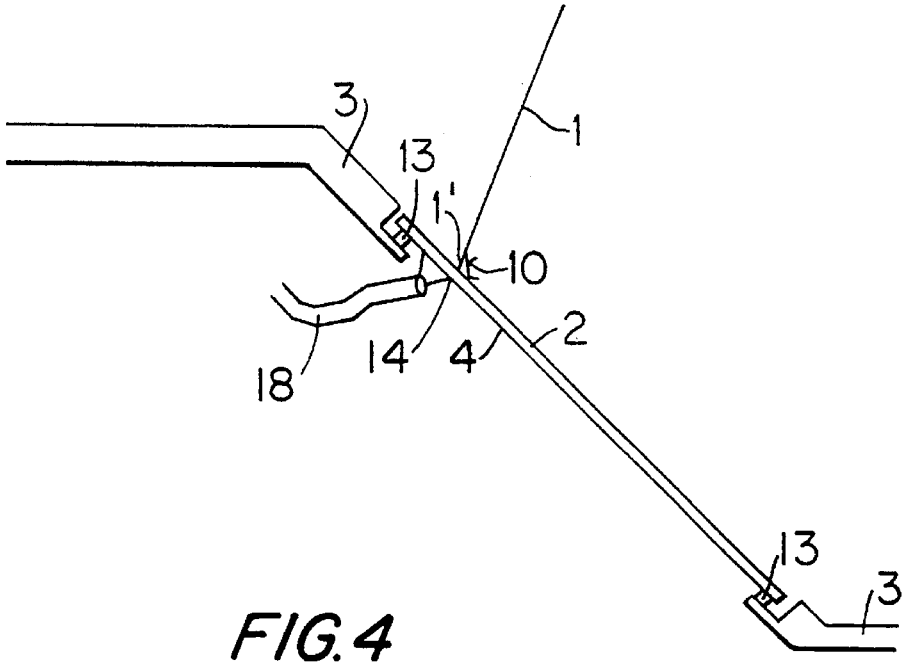
FIG. 4 is a schematic side cross-sectional view of an additional embodiment of an antenna arrangement according to the invention, with a glued antenna and with a two-dimensional component which extends over the entire window pane opening.
Figure 5:
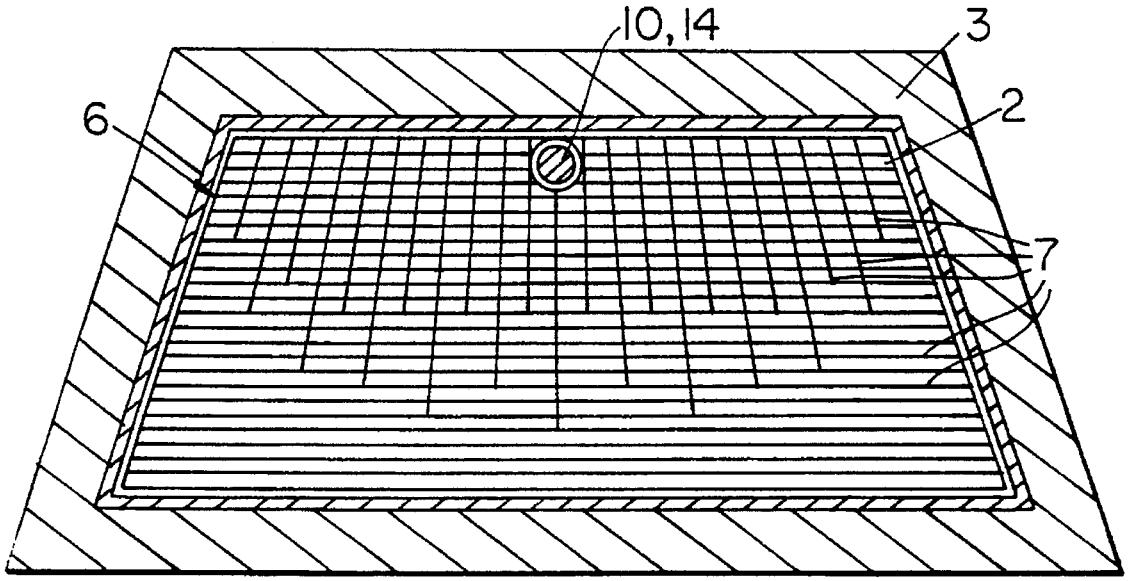
FIG. 5 is a schematic plan view of the antenna arrangement according to the invention according to FIG. 4 with a flat component designed as a grid and constructed so as to result in a particularly high efficiency with respect to the reduction of fields in the interior of the vehicle in the immediate vicinity of the antenna base.

FIG. 4 shows an antenna arrangement according to the invention for a glued antenna 1 in a sectional view in which these aspects are taken into account. FIG. 5 shows a plan view of the same arrangement again. The antenna base is again designated by 1'. In the antenna arrangements according to the invention, this point of attachment 10 is preferably located in the interior of the region covered by the two-dimensional component 4, since particularly concentrations occur in the region of the base 1' of the antenna 1.

In such an antenna the surface of the glued antenna 1 facing the window pane, which also forms the mechanical connection to the latter, is typically constructed so as to be metallically conducting in such a way that a lowimpedance connection of sufficient capacitance is provided through the window pane to a metallic counter-surface 14 on the inside of the window pane. The inner conductor of a coxial line 18 producing the signal connection to the radio equipment is connected to at this counter-surface 14. In the antenna arrangements according to the invention, the outer conductor of the coral line 18 is connected to the two-dimensional component 4 in the vicinity of the counter-surface 14. Due to the shielding effect of the two-dimensional component 4, there are also no sheathing waves on the coxial line 18.

In the example shown in FIG. 4 and in FIG. 5, the two-dimensional component 4 again covers the entire surface of the window pane with the exception of the region in which the transmission in of the signal from the coaxial line 15 to the glued antenna 1 through the window pane is effected. However, the density of the printed conductors 7 varies in different regions of the two-dimensional component 4, i.e. it is higher in the upper region of the window pane 2, again principally in the center, and in the lower region where the conductor density is markedly lower at the edges.

Concentric circles (FIG. 5), rectangles or squares are possible geometrical forms for the counter-surface 14 and the cut out in the two-dimensional component 4 for this counter-surface. The necessary size of the counter-surface 14 and surface at the base of the glued antenna 1 is known from commercially available antenna types and is typically 2 to 4 $cm^2$, e.g. at the frequencies of the C-network or D-network radio telephone.

Of course, the signal can also be fed to the glued antenna 1 from outside, that is, not only capacitively through the window pane as assumed in FIGS. 4 and 5, for antenna arrangements according to the invention while retaining its advantages. However, due to the problematic cable placement, this technique is rarely applied in practice with glued antennas.

The two-dimensional, optically transparent two-dimensional component 4, which is however extensively opaque for radio waves in radio broadcast frequency ranges, can be realized in different ways. In addition to evaporating a thin metallic coating on the surface of the window pane as already mentioned, its realization by wire-shaped conductors 7 which are applied by silk screen printing are of particular practical interest.

The specific configuration of the fields which must be prevented from penetrating into the interior of the vehicle must be taken into account to form the low surface resistance in the radio broadcast frequency range required for the antennas according to the invention. Flat structures with a thickness greater than the penetration depth at radio broadcast operating frequency are very well suited for forming the two-dimensional component 4. A close meshed wire grid 6, as shown in FIG. 5, has the same effect. Differences compared to a flat structure which is evaporated on only result at a very short distance from the two-dimensional component 4, i.e. in the range of a few centimeters. Close meshed is usually understood as a mesh width not substantially in excess of 1/10 of the average radio broadcast operating wavelength. This is also the case in the antenna arrangements according to the invention. Accordingly, the mesh width for the frequency range of the C-network mobile telephone is around 7 cm and approximately 3 cm for the D network. Greater mesh widths are still effective, but have a lower efficiency especially in the vicinity of the grid. Mesh widths substantially greater than ¼ of the average radio broadcast operating wavelength are only suitable for antenna arrangements according to the invention under very restricted conditions.

For the reasons mentioned above, it is particularly important that the efficiency in the vicinity of the antenna base 1' is high and the mesh width is accordingly selected so as to be sufficiently close. The mesh width can be increased at a greater distance from the antenna base 1' or the number of conductors can be decreased, e.g. in the manner shown in FIG. 5, without forfeiting the advantages of the invention.

Figure 10:
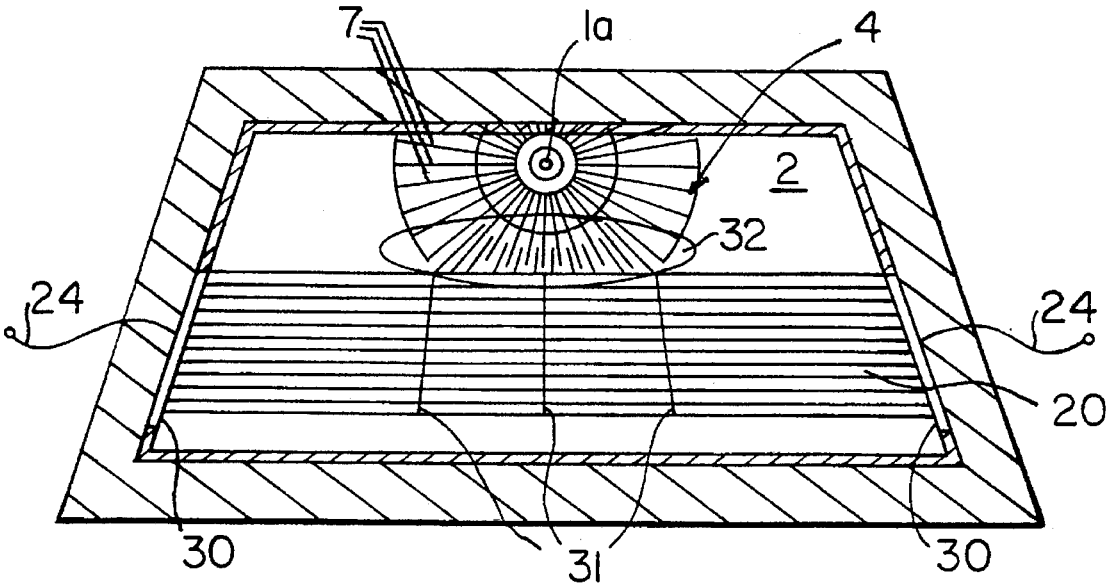
FIG. 10 is a plan view of the antenna arrangement according to the invention according to FIG. 9; the two-dimensional component is predominantly formed by radially arranged conductors.

FIG. 10 shows another advantageous embodiment of a two-dimensional component 4 in which the reverse currents to the antenna base are effectively picked up detected in conductors 7 running toward the antenna base 1' in a star-shaped manner. This two-dimensional component 4 which is not very extensive with respect to surface area already considerably reduces the fields in the interior. FIG. 8 shows a large structure of similar surface area as that in FIG. 10 which substantially extends on the window pane 2 in the vicinity of the antenna base 1'.

The efficiency of a two-dimensional component which meets the object of the invention decreases as the surface covered by the two-dimensional component 4 decreases. However, since the field strengths are highest in the vicinity of the base and decrease quickly as their distance from the latter increases, structures 4 covering a comparatively small surface area are also capable of a significant reduction in the field strengths in the interior of the vehicle. The necessary extent of surface area covered by the two-dimensional component 4 accordingly also depends on the maximum transmission output, since only a slight reduction of the fields is required for low transmission outputs.

Antenna arrangements according to the invention concern radio equipment with at least average output. This includes HF outputs in the range of more than roughly 5 W, that is outputs at which the field strengths in the passenger compartment exceed the limits outlined in DIN Draft 0848 at least in the region of the interior without the construction according to the invention.

Naturally, at a HF output of 5 W, for example, the surface of the window pane 2 covered by the two-dimensional component 4 can be less for example than that at the maximum output of roughly 25 W used in the C network. As concerns a lower limit for the meaningful use of an antenna arrangement according to the invention for an output of approximately 5 W in combination with an antenna shape generating pronounced fields in the vicinity of the base 10, it may be said with respect to the dimensions of the two-dimensional component 4 based on measurements that the dimensions 36 and 37 and 35 (FIG. 8) may not be substantially less than approximately ¼ of the average operating wavelength in the radio broadcast frequency range. At higher frequencies at which the operating wavelength is yew small, the dimensions may be no less than approximately 10 cm in the case of dimensions 27 and 35. The sum of the dimensions 36 and 37 is 27.

In practice, there are usually additional structures on the window pane 2, e.g. heating fields 20 or structures 34 for radio reception antennas, at least when this window pane is the rear window pane of a vehicle.

Figure 7:
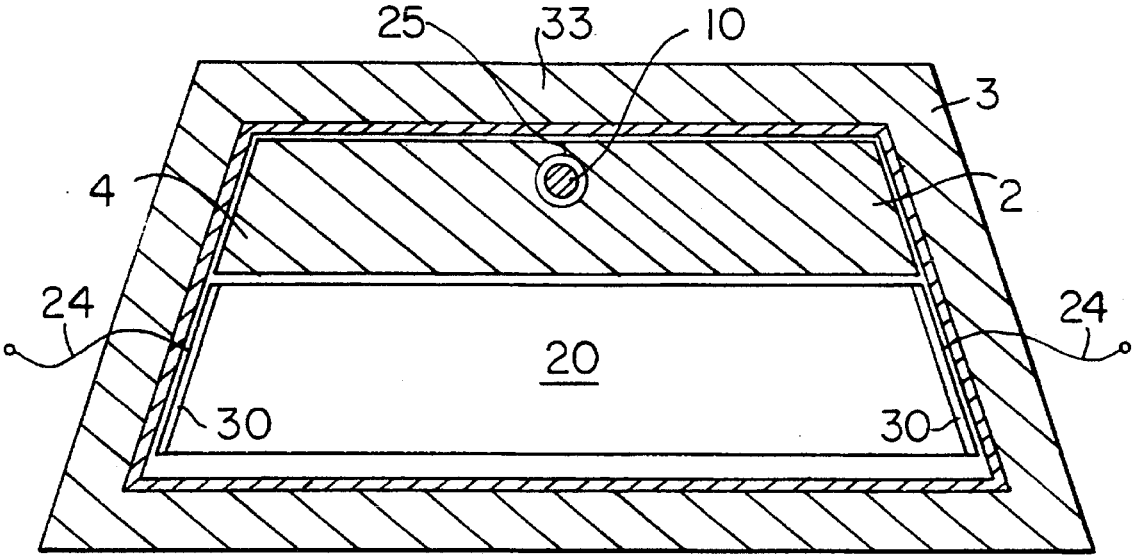
FIG. 7 is a schematic plan view of the antenna arrangement according to the invention according to FIG. 6.

Examples of antenna arrangements according to the invention in combination with heating fields 20 are shown in FIGS. 7, 8 and 10.

In the example shown in FIG. 7, it is assumed that the heating field 20 does not have the characterizing features of a two-dimensional component 4 with respect to the construction and electrical circuitry in the radio broadcast frequency range, e.g. it does not have a low-impedance connection with the body 3. Therefore, the electromagnetic fields radiating from the radio antenna are attenuated only slightly or not at all by the heating field 20. However, since the fields of the outer antenna 1 in the lower region of the window pane in which the heating field 20 is arranged are less than in the upper region of the window pane for the reasons stated above and moreover since it is hardly possible in practice for parts of the passengers' bodies to come close to the lower portion of the window pane, it is often sufficient to arrange the two-dimensional component 4 only in the upper region of the window pane as shown in FIG. 7.

In the example of an antenna arrangement according to the invention as shown in FIG. 8, it was assumed that a shielding is necessary also in the lower region of the vehicle window pane 2. For this purpose, the low-impedance connection between the structure of the heating field 20 and the body 3 is again achieved, for example, via the bus bars 30 of the heating field 20 which lie directly opposite the body and via the bead of glue. In this way, the heating field 20 at the same time becomes part of the two-dimensional component 4, and accordingly achieves the objective of the invention with respect to a reduction of the electromagnetic fields in the interior of the vehicle.

In the example shown in FIG. 8, a glue with good dielectric, but low-impedance, conductivity is advantageously used to prevent a direct current connection between the bus bars 30 and the body via the glue.

In the example shown in FIG. 10, the heating field 20 likewise has a low-impedance connection with the body in the region of the bus bars and is accordingly also a component part of the two-dimensional component 4. If, as is often the case, the heating field is composed only of horizontal conductors in the region of the window pane opening, the shielding action, although present, may not be sufficient. However, the shielding effect of the heating field 20 acting as two-dimensional component 4 can be further improved by taking extra measures in terms of efficiency within the meaning of the invention. For this purpose, three additional conductors 31 are provided in the middle in the example shown in FIG. 10. These conductors 31 are arranged virtually vertically, can guide currents in the direction of the antenna base 1', and are arranged on lines of equal potential with respect to the heating conductors so that no heating current can flow in the transverse direction. This effect can be further improved by the interdigital structure 32 forming a capacitive connection between the two-dimensional component wire conductors 7 and the heating conductors 20.

Different antenna types can be used as exterior radio antennas. Antennas having a low-ohm antenna base impedance relative to the base surface are widely used, e.g. lambda/4, ⅝ lambda or ¾ lambda radiators which have an antenna base impedance in the neighborhood of the 50-ohm characteristic resistance of conventional coaxial cable whose advantage consists in simple adaptation to the feeder cable. However, the use of these antenna shapes involves extensive reverse currents on the base surface. Therefore, losses causing an undesirable reduction in efficiency in the outer antenna 1 may occur depending on the electrical characteristics of the base surface, that is, on its surface impedance.

This does not pose any technical problem when the exterior radio antenna is arranged, for example, in the center of the roof of a vehicle, since the body has a very low surface impedance with low losses.

In the antennas according to the invention, however, the exterior radio antenna 1 is arranged in the vicinity of a window pane opening formed by a vehicle window pane 2. Thus, if a two-dimensional component 4 of conductive material with low surface resistance is arranged entirely or partially in the radio broadcast frequency range, at least a portion of the currents flow back to the antenna base along parts of the two-dimensional component 4. To solve the problem posed by the invention, i.e. to effect a significant reduction in the fields in the passenger compartment, it is sufficient that the surface resistance of the structure has a low impedance in comparison to the free-space field characteristic resistance, i.e. 377 ohms. An impedance which is at least five times lower may be considered sufficient to achieve a significant reduction in the fields in the interior, e.g. by 6 dB.

However, with respect to the coupling of losses into the antenna circuit resulting in reduced effectiveness, the surface impedance is subject to additional requirements depending on the type of antenna. Therefore, in the case of the antennas with comparatively high antenna base currents which were discussed above, the attempt must be made to make the surface impedance of the structure, if possible, as conductive as the metallic body, for example. For example, this may require a surface-area coating with a correspondingly high specific conductivity or a correspondingly high thickness which would cause an unacceptable decrease in optical transparency.

If this two-dimensional component 4 is to assume the function of a window heater at the same time, it must satisfy additional requirements with respect to ohmic conductivity for direct current. The selection of a suitable coating type therefore assumes an important role in the antenna arrangements according to the invention, especially with exterior radio antennas 1 with high antenna base currents. However, since coatings having very different electrical properties are available at present, this does not present a limitation of the applicability of the antenna arrangements according to the invention.

In the case of printed conductor structures, the surface resistance can be varied by changing the relative distance between the conductors. Moreover, the surface resistance for radio broadcast frequencies can be adjusted even within wide limits regardless of the resistance for direct current (heating field) e.g. by means of a very thin electro-deposited layer, since the penetration depth at high frequencies is extremely small, whereas the entire cross section is filled with current in the case of DC current.

With other types of antenna, a different situation is presented in relation to the requirements for the surface impedance of the structure 4. Such antenna shapes are characterized by a low current in the antenna base which also results in low currents on an adjacent base surface or structure 4. In a particularly advantageous manner, this does not result in any requirements for low impedance relative to 377 ohms beyond those made by the invention.

Figure 9:
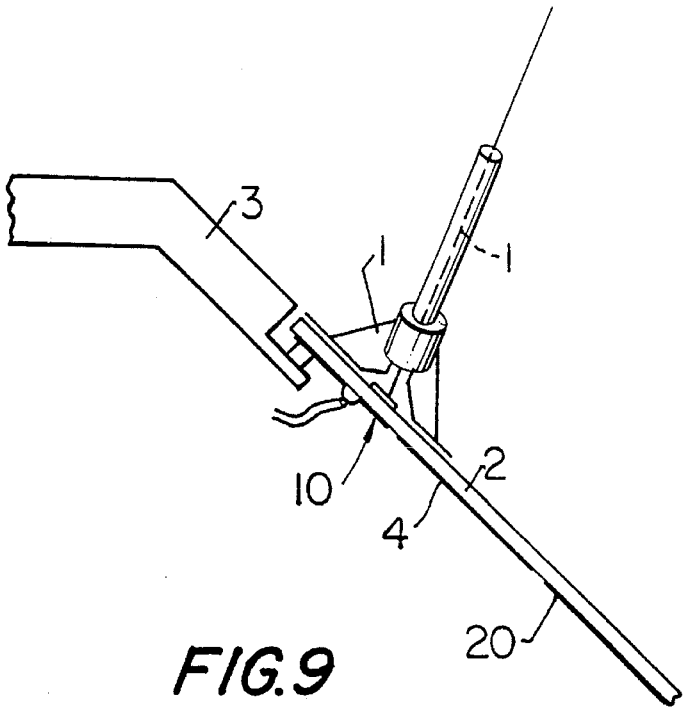
FIG. 9 is a schematic side cross-section view of an additional antenna arrangement according to the invention with a glued antenna of dipole character fed coaxially from below and with a two-dimensional component which is connected with the body so as to be conductive only along an edge of the window pane; the heating field is arranged in the lower region of the window pane.

Such antenna shapes are, for example, bottom-fed lambda/2-dipoles which are, however, costly to adapt to coaxial cables of conventional characteristic resistance. Of particular advantage for the antenna arrangements, according to the invention, is the use of antennas which are fed coaxially through the antenna base according to P 40 07 824.8 (FIG. 9) which are preferably suited for glued antennas.

Because of the typical field configurations with lines of flux which close substantially between the dipole halves, there are only very low reverse currents on the two-dimensional component 4. For this reason it need not assume the function of a balancing antenna and no substantial losses occur in the two-dimensional component 4 if the structure fulfills the objective of the invention, to prevent the coupling of electrical energy from the radio antenna into the passenger compartment. The low currents on the two-dimensional component 4 result from Comparatively few lines of flux occurring on the two-dimensional component 4. Therefore, the loading of the passenger compartment with electrical energy is basically already comparatively low with this type of antenna. The required extent of reduction of the fields in the passenger compartment is consequently also less than with antennas with large feed currents in the base. The proportion of the surface of the window pane 2 which must be provided with the two-dimensional component 4 to exclude risk to the passengers is therefore likewise less than that required in outer antennas with large base currents.

Figure 11:
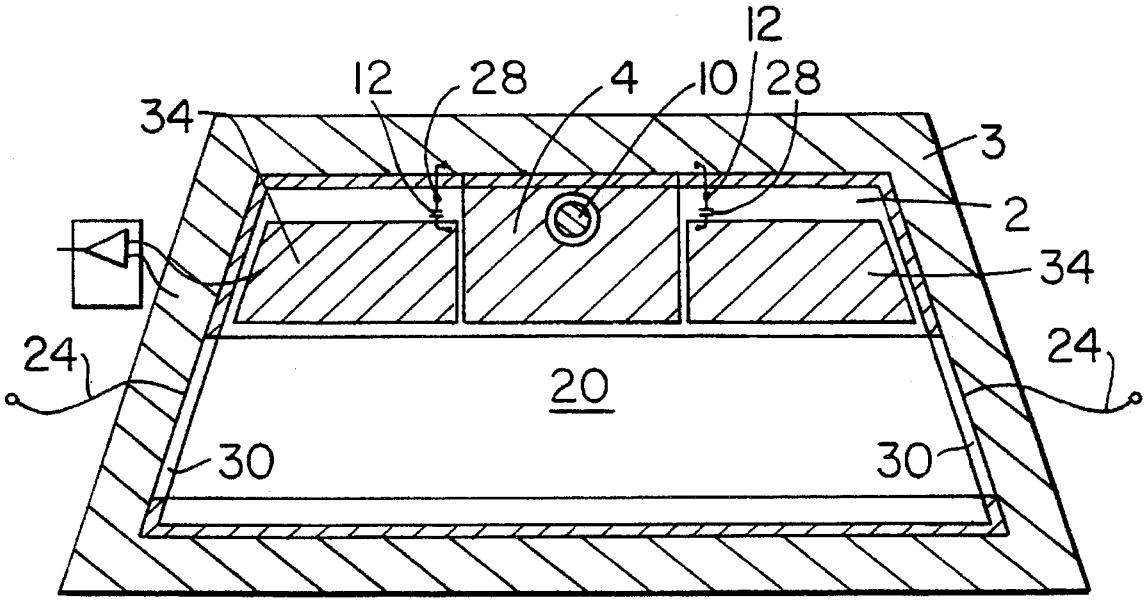
FIG. 11 is a plan view of an antenna arrangement according to the invention in which radio broadcast signals can be received at the same time.

Window pane antennas are used increasingly in modern vehicles for radio broadcast reception. These antennas sometimes use the heating field and sometimes also separate structures 34 as antenna elements. Antenna arrangements according to the invention can advantageously be combined with the known antenna structures 34 for radio broadcast reception. An example is shown in FIG. 11. In this example, the two-dimensional component 4 is formed from a plurality of regions. The region 4 extending in the immediate vicinity of the antenna base 1' has, for example, a low-impedance connection with the body 3 at the upper edge of the two-dimensional component 4 via the glue bead. The heating field 20 is a component part of the two-dimensional component, by reason of the low-impedance connection in the region of the bus bars. The structures 34 serve in a known manner as antenna elements for radio broadcast reception, e.g. particularly advantageously in the embodiment form of an active antenna. The antenna structures 34 become part of the flat component 4 in that they are connected at low impedance with the body via wire bridges which are compensated for radio broadcast frequencies and which accordingly have the character of series resonance circuits with an artificial inductance 28 and a series-connected capacitor 12. Due to the very low value of the capacitor 12, there is only a negligible capacitive loading of the structures 34 for lower frequencies, e.g. LF and VHF radio spectrum, so that the output of the radio reception antennas is not impaired in an unacceptable manner.

We claim:

1. An antenna arrangement for a motor vehicle, said antenna arrangement comprising an exterior radio antenna (1) for radiating electromagnetic waves in a radio frequency broadcast range;

a vehicle window pane (2) closing an opening provided in a metallic body (3) of the motor vehicle, the exterior radio antenna (1) being arranged on one of the metallic body (3) and the vehicle window pane (2) and located outside of an interior of the motor vehicle, and means for shielding said interior of the motor vehicle from the electromagnetic waves radiated by the exterior radio antenna (1), said means for shielding comprising a two-dimensional component (4) arranged on at least a portion of the vehicle window pane (2) and made of a conductive material substantially optically transparent but substantially opaque to said electromagnetic waves in the radio broadcast frequency range radiated by the exterior radio antenna (1) and an electrically conductive capacitive connection (11,12,13) for said electromagnetic waves in the radio broadcast frequency range between said two-dimensional component (4) and said metallic body (3), wherein said two-dimensional component (4) has a sufficiently low surface resistance in the radio broadcast frequency range and said electrically conductive capacitive connection (11, 12,13) of the two-dimensional component (4) to the metallic body (3) is of sufficiently low impedance in the radio broadcast frequency range so that electric and magnetic fields radiated by the exterior radio antenna (1) in the radio broadcast frequency range are effectively prevented from penetrating into said interior of said motor vehicle.

2. The antenna arrangement as defined in claim 1, wherein said two-dimensional component is a conductive coating applied to said window pane (2) and having at least one coating edge extending along and adjacent to at least one edge of the metallic body (3).

3. The antenna arrangement as defined in claim 2, wherein an edge portion of said conductive coating adjacent said at least one coating edge overlaps a corresponding edge portion of said metallic body (3) at said at least one edge of said metallic body (3) adjacent said at least one coating edge to form said electrically conductive capacitive coupling.

4. The antenna arrangement as defined in claim 3, further comprising a conductive glue between said edge portion of said conductive coating and said metallic body.

5. The antenna arrangement as defined in claim 1, wherein said two-dimensional component (4) is a metallic coating applied to at least a portion of the window pane (2).

6. The antenna arrangement as defined in claim 5, wherein said metallic coating is transparent to light but has said sufficiently low surface resistance in said radio broadcast frequency range.

7. The antenna arrangement as defined in claim 1, wherein said two-dimensional component (4) is an electrically conductive grid comprising a plurality of conductors printed on said window pane (2).

8. The antenna arrangement as defined in claim 1, wherein said two-dimensional component (4) has a horizontal dimension (27) equal to at least half of an average operating wavelength of said radio frequency broadcast range, but not less than 10 cm, and a vertical dimension (35) equal to at least one fourth of said average operating wavelength, but not less than 10 cm.

9. The antenna arrangement as defined in claim 1, wherein the exterior radio antenna (1) is attached to the vehicle window pane (2) at an attachment point (10) and the attachment point (10) is inside a region covered by the two-dimensional component (4).

10. The antenna arrangement as defined in claim 1, wherein the two-dimensional component (4) comprises an arrangement (6) of conductors (7) and said conductors (7) are oriented parallel to one another.

11. The antenna arrangement as defined in claim 10, wherein the exterior radio antenna (1) is attached to the vehicle window pane (2) at an attachment point (10), the exterior radio antenna (1) has an antenna base (1') at said attachment point (10) and a distance between said conductors (7) adjacent to the antenna base (1') is less than 1/10 of an average free-space wavelength for the radio broadcast frequency range.

12. The antenna arrangement as defined in claim 1, wherein the electrically conductive capacitive connection (11,12,13) between the two-dimensional component (4) and the metallic body (3) is electrically equivalent to a series-resonant circuit having a resonance frequency approximately equal to a center frequency of said radio broadcast frequency range and the exterior radio antenna (1) is attached to the vehicle window pane (2) at an attachment point (10).

13. The antenna arrangement as defined in claim 12, wherein said electrically conductive capacitive connection (11,12) comprises an inductively acting connecting wire (11) and a capacitor (12) electrically connected in series with the connecting wire (11), said connecting wire (11) and said capacitor (12) electrically connect a connection point (25) on the two-dimensional component (4) and a connection point (33) on the metallic body (3), and the connection point (25) on the two-dimensional component (4) is adjacent the attachment point (10) of the exterior radio antenna (1) at an edge of the two-dimensional component (4) adjacent to the metallic body (3) and the connection point (33) on the metallic body (3) is as close as possible to the connection point (25) and said capacitor (12) has a capacitance value such that said series-resonant circuit comprises said connecting wire (11) and said capacitor (12).

14. The antenna arrangement as defined in claim 12, wherein said electrically conductive capacitive connection (11,12,13) comprises an upper edge portion of the two-dimensional component (4) and an opposite edge portion of the metallic body (3) in such a way that the electrically conductive capacitive connection with the metallic body (3) is produced.

15. The antenna arrangement as defined in claim 1, wherein said two-dimensional component (4) extends over an entire surface of the vehicle window pane (2), with the exception of a region for signal coupling to the exterior radio antenna (1), and as far as all edges of the opening of the vehicle window pane (2).

16. The antenna arrangement as defined in claim 1, wherein said two-dimensional component (4) extends over only partial areas (9) of the opening of the window pane (2) and the two-dimensional component (4) extends to three edges of the opening of the vehicle window pane (2).

17. The antenna arrangement as defined in claim 1, wherein the two-dimensional component (4) extends over only partial areas of the opening of the window pane and the two-dimensional component (4) extends to only one edge of the opening of the vehicle window pane.

18. The antenna arrangement as defined in claim 1, wherein the exterior radio antenna (1) has an antenna base (1') attached to an attachment point (10) on the window pane (2) and comparatively large reverse currents to said antenna base (1').

19. The antenna arrangement as defined in claim 1, wherein the exterior radio antenna (1) has an antenna base (1') attached to an attachment point (10) on the window pane (2) and comparatively small reverse currents to said antenna base (1').

20. The antenna arrangement as defined in claim 1, wherein the exterior radio antenna (1) is attached at an attachment point (10) on said window pane (2) by adhesive means, and further comprising means for transmitting a radio signal for said exterior radio antenna (1) capacitively through said window pane (2).

21. The antenna arrangement as defined in claim 1 wherein said two-dimensional component (4) includes two partial regions, and one of the partial regions is simultaneously a heating field (20) for heating a portion of said window pane (2).

22. The antenna arrangement as defined in claim 1 further comprising other two-dimensional components provided on other vehicle window panes, said other two-dimensional components providing means for preventing transmission of said electromagnetic waves from the exterior radio antenna (1) through said other vehicle window panes.

23. The antenna arrangement as defined in claim 1, further comprising antenna structures (34) for receiving radio frequency broadcast signals mounted on the vehicle window pane (2).

24. The antenna arrangement as defined in claim 23, wherein the antenna structures (34) are part of said two-dimensional component (4).

25. The antenna arrangement as defined in claim 1, wherein the two-dimensional component (4) comprises an arrangement (6) of printed conductors (7), said printed conductors forming a grid on said window pane (2).

26. The antenna arrangement as defined in claim 1, wherein the two-dimensional component (4) comprises an arrangement (6) including a plurality of glass sheets and conductors (7) with said conductors (7) inserted between said glass sheets.

* * * * *